US006596931B2

(12) United States Patent
Baker, Jr.

(10) Patent No.: US 6,596,931 B2
(45) Date of Patent: Jul. 22, 2003

(54) UKELELE MADE FROM KOA AND COCONUT SHELLS

(76) Inventor: George W. P. K. Baker, Jr., 607-A Kuaaina Way, Kailua, HI (US) 96734

( * ) Notice: Subject to any disclaimer, the term of this patent is extended or adjusted under 35 U.S.C. 154(b) by 127 days.

(21) Appl. No.: 09/900,541

(22) Filed: Jul. 9, 2001

(65) Prior Publication Data

US 2003/0005807 A1 Jan. 9, 2003

(51) Int. Cl.[7] ..... G10D 3/00

(52) U.S. Cl. ..... 84/291; 821/267; 821/290; 821/294

(58) Field of Search ..... 84/291, 267, 290, 84/294, 410, 411 R, 416

(56) References Cited

U.S. PATENT DOCUMENTS 1,381,494 A * 6/1921 Olsen ..... 84/411 R
3,440,919 A * 4/1969 Baker ..... 84/267
4,580,480 A 4/1986 Turner
4,632,003 A 12/1986 Kopp
5,301,591 A * 4/1994 Greenberg ..... 84/411 R
5,406,874 A * 4/1995 Witchel ..... 84/291
5,567,894 A 10/1996 Shiomi

* cited by examiner

*Primary Examiner*—Shih-Yung Hsieh

(57) ABSTRACT

An improved ukelele made from koa wood and coconut shell sidewalls provides a unique, deeper, pleasing musical tone. A stringed musical instrument comprises a body having an upper sounding board, a lower sounding board, and a convex sidewall. The sidewall is connected peripherally to the upper and lower sounding boards, for defining a resonant cavity. A longitudinal neck portion extends on an axis away from the body. The instrument has a plurality of strings tensioned between the body and the neck adjacent said upper sounding board. Tensioning means is provided for tensioning said strings to a desired level.

The upper sounding board includes an aperture positioning in an upper central position, with a plurality of strings passing over the aperture on the outside of the body. The upper and lower sounding boards are comprised of a Hawaiian hardwood selected from one of the group of koa and milo. The convex side-walls comprise of a plurality of sectors made from hardened coconut shells and glued together to form a contiguous peripheral sidewall between said upper and lower sounding boards.

6 Claims, 5 Drawing Sheets

UKELELE MADE FROM KOA AND COCONUT SHELLS

RELATED APPLICATIONS

This invention was originally disclosed in Disclosure Document No. 455205 filed on Apr. 22, 1999.

BACKGROUND OF THE INVENTION

I. Field of the Invention

This invention relates to a ukelele, and more particularly to stringed acoustical musical instruments having made from koa wood, and coconut shells.

II. Background

The ukelele is a small, guitarlike musical instrument associated chiefly with Hawaiian music. It produces a unique, pleasing, acoustical sound when strummed. The Hula is a native dance performed by Hawaiians, usually to a traditional tune played on a ukelele.

Koa is defined as a Hawaiian acacia or *Acacia koa,* of the legume family, having gray bark. It produces a hard red or golden-brown wood, typically used for making furniture. The natural vegetation of Hawaii is conditioned by its isolation, which ha served to limit the number of species, and by the interplay of its mountains and the moist trade winds. The dry leeward (SW) coasts of Hawaii are virtual deserts, with spiny koa and kiawe shrubs growing on the slightly wetter slopes.

Coconut is the common name for the fruit of a tree, *Cocos nucifera,* of the family Arecaceae. The tree and its fruit are widely distributed in tropical regions, including Hawaii. The tree, called coconut palm, has a cylindrical trunk, about 45 cm (about 18 in) in diameter and can grow up to 30 m (100 ft) high. At the summit it bears a crown of about 20 pinnate leaves that generally curve downward, each of which is about 3 to 4.5 m (about 10 to 15 ft) long. The fruit grow in clusters of 10 to 20 or more nuts. The mature coconut, about 30 cm (about 12 in) long, is oval-shaped and has a thick, fibrous outer husk and a hard inner shell.

SUMMARY OF THE INVENTION

The three components set forth above, ukelele, koa wood, and coconuts, have notably been unrelated in any way up until the creation of the present invention. The sounds which emanate from a ukelele can be modified to produce unique pitch and deeper tonal qualities never before experienced. The improvement to the ukelele is accomplished by the use of Koa wood, or a similar type of wood as milo wood, both of which are very hard woods such as are normally used for furniture. The flat, peanut-shaped sounding boards are made from the hardwood Koa or milo, and are attached via sidewalls, made from dried, hard coconut shells.

Musicians are constantly in search of the unique sound which expresses the creativity and originality that sets them apart from the mainstream, that draws attention to their work. The present invention provides yet another for musical artists to express that creativity.

What is disclosed is an improved stringed musical instrument comprising a body having an upper sounding board, a lower sounding board, and a convex sidewall. Sidewall is connected peripherally to the upper and lower sounding boards, for defining a resonant cavity. A longitudinal neck portion extends on an axis away from the body. The instrument has a plurality of strings tensioned between the body and the neck adjacent said upper sounding board. Tensioning means is provided for tensioning said strings to a desired level.

The upper sounding board includes an aperture positioned in an upper central position, with a plurality of strings passing over the aperture on the outside of the body. The upper and lower sounding boards are comprised of a Hawaiian hardwood selected from one of the group of koa and milo. The convex sidewalls comprise of a plurality of sectors made from hardwood coconut shells and glued together to form a contiguous peripheral sidewall between said upper and lower sounding boards. The preferred embodiment of this stringed instrument is a ukelele.

Further, the neck also comprises a fingerboard having a plurality of frets for compressing the strings between a player's fingers and the fret for producing a desired sequence of musical notes.

It is an object of the present invention to provide an improved stringed instrument, particularly a ukelele, with a unique, deepened tonal quality resultant from materials of construction including sounding boards made from koa wood or milo, and sidewalls made from dried coconut shells, which are cut, sanded, and glued together.

It is another object of the present invention to provide a uniquely shaped ukelele having convex sidewalls made of sanded coconut segments, and koa wood.

It is a further object of the present invention to provide a ukelele which includes a graphical design visible through the front aperture of the body.

Accordingly, I have provided the detailed description and drawings as follows.

DETAILED DESCRIPTION OF THE INVENTION

Figure 1:
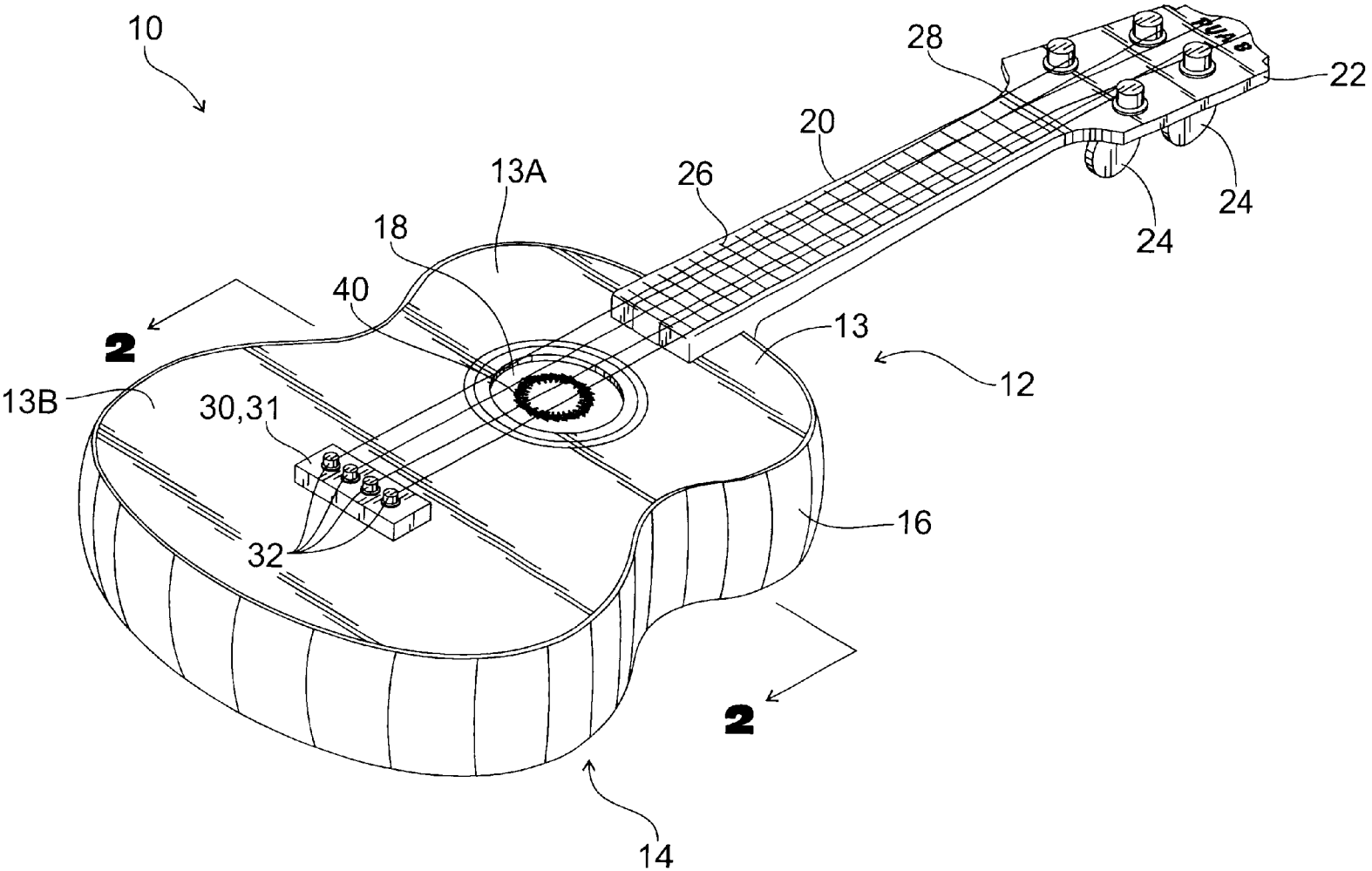
FIG. 1 is an isometric view of the ukelele.

Referring first to FIG. 1, a ukelele is generally designated as 10. Body 12 defines a hollow wooden cavity 42, with a solid, longitudinal neck portion 20 extending axially away from said body 12. Body 12 has a pair of sounding boards 13, 14. Upper sounding board 13 has two lobes 13*a,* 13*b,* which combine to form a guitar- or peanut-shaped planar surface, with an aperture 18 located centrally, but biased toward the upper, smaller lobe portion 13*a* nearest neck portion 20. Lower sounding board 14 is spaced from and generally the same shaped and size of, upper sounding board 13. The sounding boards 13, 14 are connected through a vertical, convex sidewall 16.

End portion 22 is disposed at the end of neck portion 20 opposite from body 12. On neck portion 20, there are a plurality of rotatable tuning nuts 24 to which strings 25 are connected and wound to the desired tautness for producing harmonious melodies. A guide bar 28 traverses neck 20 adjacent end portion 22, with slots for arranging strings 25 in longitudinal lines parallel to the axis of neck 20. At the other end, strings 25 are connected to a bridge and crown 30,31. Bridge and crown 30,31 provide termination and guides for strings 25. Bridge and crown 30,31 are located on the side of sounding board 13 opposite neck 20.

Figure 2:
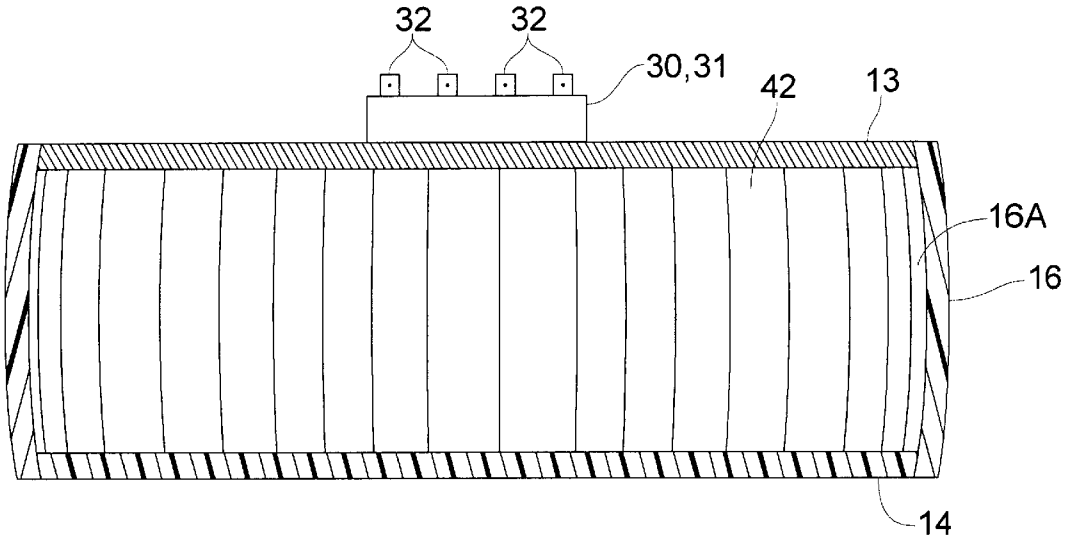
FIG. 2 is a sectional view taken along the lines 2—2.
Figure 2A:
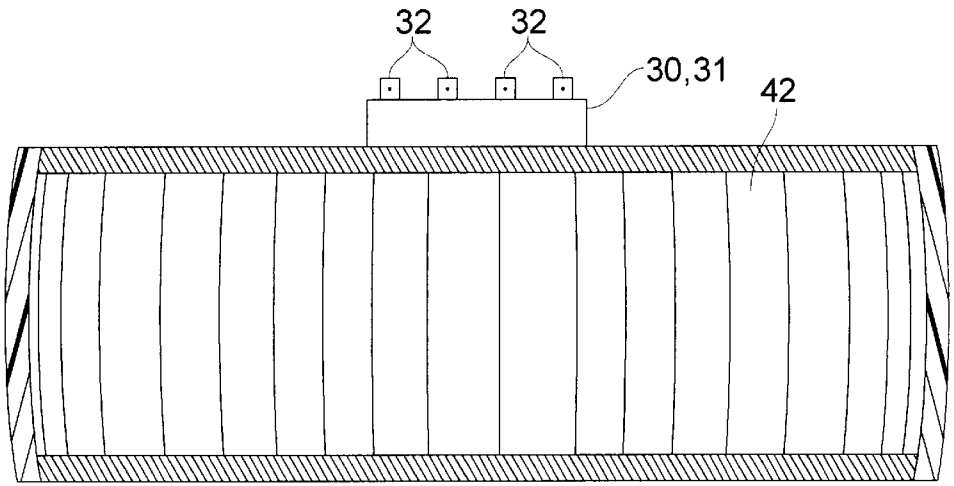
FIG. 2A is a sectional view showing an alternate embodiment.

Referring next to FIG. 2A, a sectional view taken along the lines 2—2 of FIG. 1 shows the bulging sidewall 16 made of a plurality of coconut shells segments 16*a*. The coconut shells segments 16*a* are made from dried coconuts. They are cut to the proper size, then surface sanded and glued together to form a contiguous sidewall 16 about the periphery of the opposing sounding boards 13, 14, to enclose the resonant cavity 42. FIG. 2A illustrates one embodiment in which different woods, koa and milo, are used to make upper and lower sounding boards, 13, 14, respectively. FIG. 2B is a preferred embodiment in which koa wood is used to make both upper and lower sounding boards 13,14.

Figure 3:
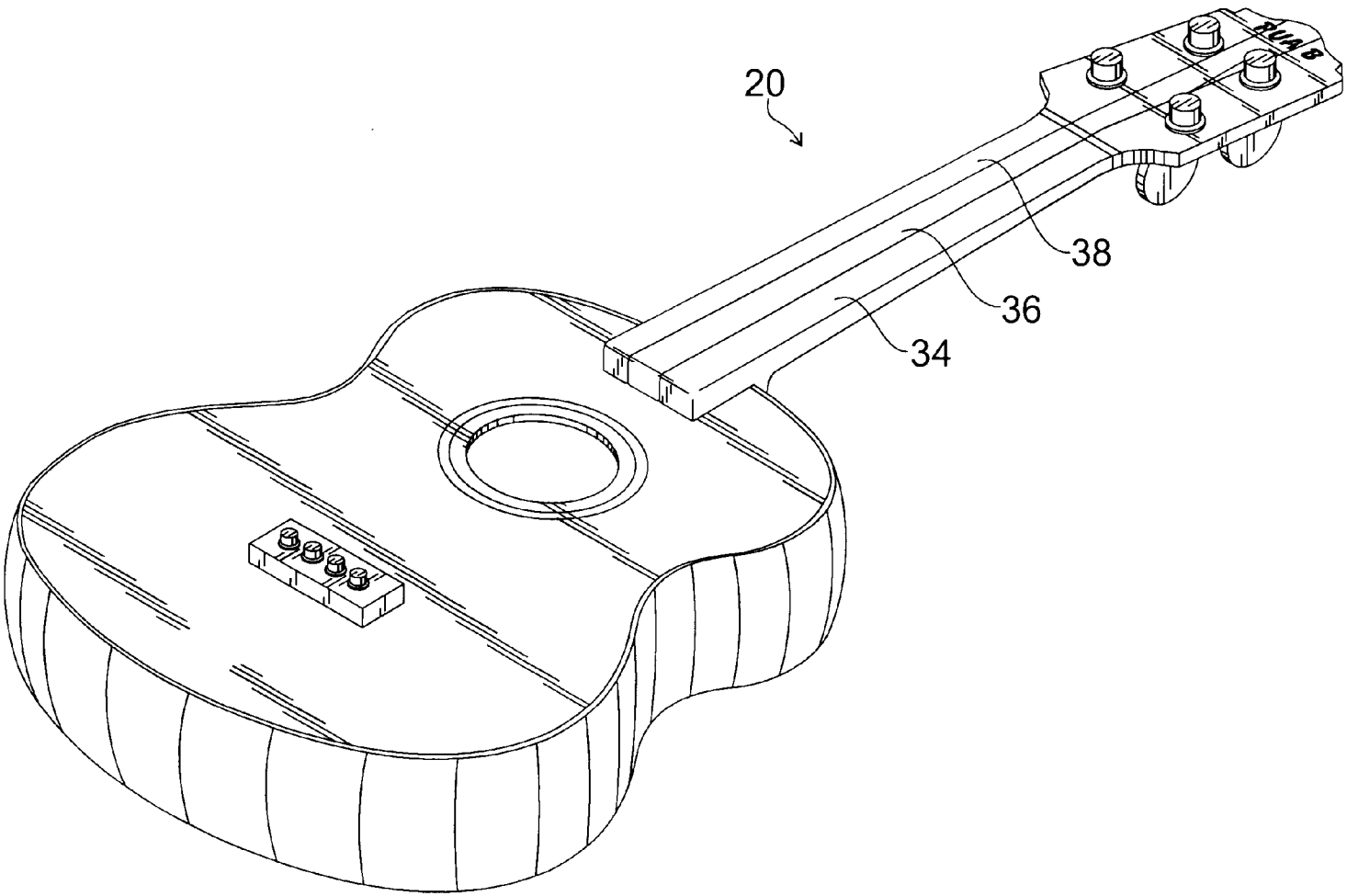
FIG. 3 is an isometric view illustrating the sectional portions of the neck.

FIG. 3 illustrates the construction of neck portion 20, which is made from three sections of wood, 34,36, and 38, which are glued and laminated together using conventional carpentry clamps to form a unitary, solid neck portion 20.

Figure 4:
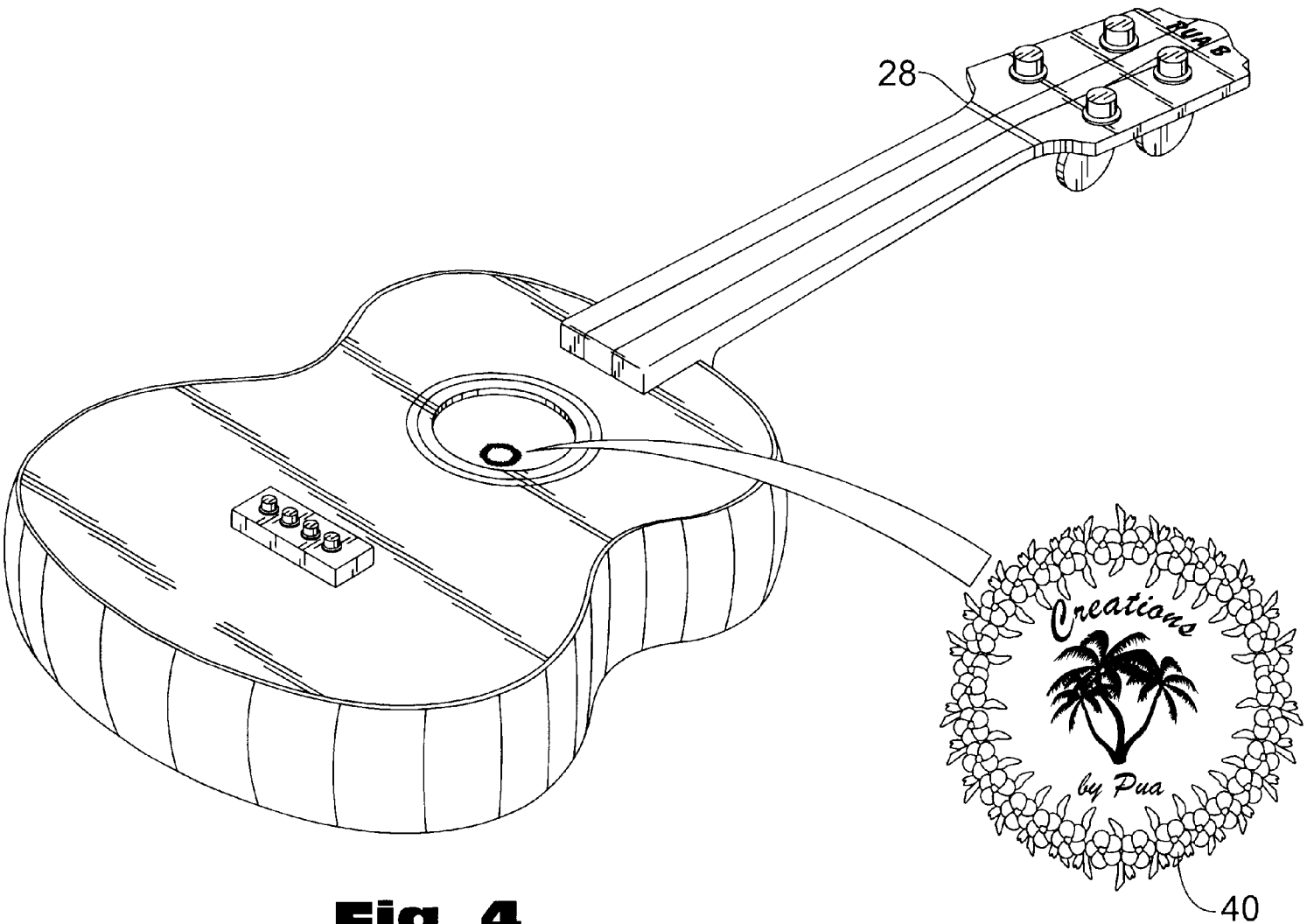
FIG. 4 is an isometric view of an alternate embodiment showing a graphic design placement.

FIG. 4 illustrates design 40, which may be the design 40 illustrated in the drawing, or any logo or graphic image, that is transferred onto the inner surface of lower sounding board 14, so that the image is viewable through the aperture 18.

Figure 5:
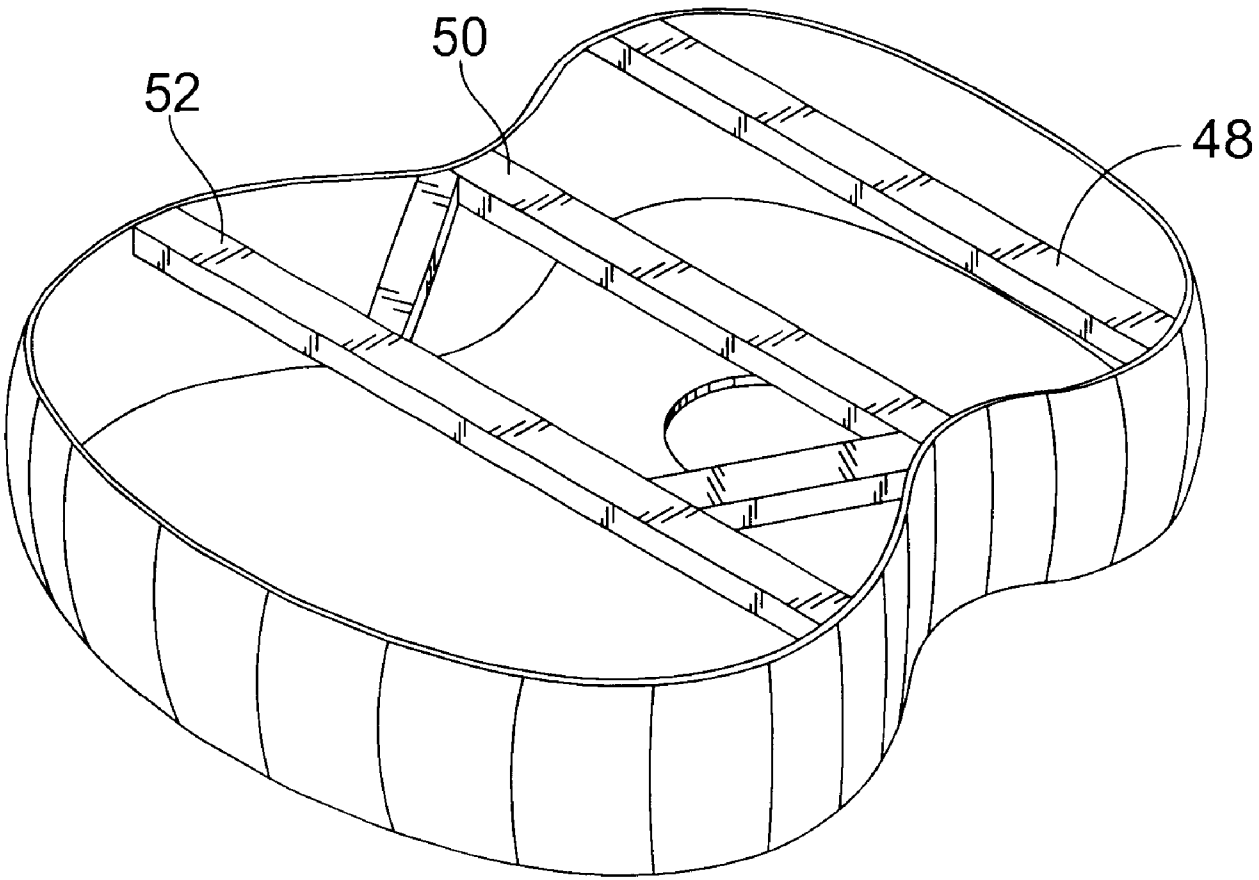
FIG. 5 is an isometric view of the inner side of a lower sounding board.

FIG. 5 shows a lower sounding board 14 inner surface, having first, second and third reinforcing lateral struts 48, 50 & 52, and first and second angle braces 54,56. Struts are placed laterally between the two widest points of the curved surface, and another 50 strut connects the narrowest points of the curvature. The reinforcement members are incorporated to maintain the shape of the rigidity and prevent wrapping of the sounding boards. Upper sounding board 13 is reinforced in the same manner.

According to the provisions of the patent status, I have explained the principle, preferred construction and mode of operation of my invention, and have illustrated and described what I know consider to represent its best embodiments. However, it should be understood that within the scope of the appended claims, the invention may be practiced, otherwise that specifically illustrated and described.

I claim:

1. An improved stringed musical instrument comprising a body, the body comprising an upper sounding board, a lower sounding board, and a convex sidewall connected peripherally to said upper and lower sounding boards, for defining a resonant cavity, a longitudinal neck extending on an axis away from the body, a plurality of strings tensioned between the body and the neck adjacent said upper sounding board, and tensioning means for tensioning said strings to a desired level;

said upper sounding board having an aperture positioned in an upper central position, said plurality of strings passing above said aperture on the outside of said body, said upper and lower sounding boards being comprised of a Hawaiian hardwood selected from one of the group of koa and milo; and said convex sidewalls being comprised of a plurality of sectors made from hardened coconut shells and glued together to form a contiguous peripheral sidewall between said upper and lower sounding boards.

2. The stringed musical instrument as set forth in claim 1, wherein the instrument is a ukelele.

3. The stringed instrument as set forth in claim 2, wherein said neck also comprises a fingerboard having a plurality of fret portions for compressing said plurality of strings between a player's fingers and the fret for producing a desired sequence of musical notes.

4. The stringed instrument as set forth in claim 3, wherein said tensioning means is comprised of a bridge portion and a crown portion situated on the exterior side of said upper sounding board, opposite of said neck portion, for grasping one end of each said plurality of strings, and a plurality of rotatable tensioning nuts located at the end of said neck portion opposite said body, such that the plurality of strings may be pulled taut over said aperture by said tensioning nuts, and plucked in a way that causes melody to resonate within said cavity.

5. The stringed instrument as set forth in claim 4, wherein also comprising a design placed within said cavity on the inner side of said lower sounding board, and opposite said aperture in said upper sounding board, such that said design is viewable through said aperture.

6. The stringed instrument as set forth in claim 5, wherein said neck is comprised of first, second and third longitudinal members, said members being comprised of said hardwood, said first, second and third members being adhesively laminated to produce a singular neck portion.

* * * * *